US005746689A

United States Patent [19]

Murphy

[11] Patent Number: 5,746,689

[45] Date of Patent: May 5, 1998

[54] METHOD FOR TRANSVERSE-FOLD POP-UP

[75] Inventor: Andrew Murphy, Baltimore, Md.

[73] Assignee: Ottenheimer Publishers, Inc., Baltimore, Md.

[21] Appl. No.: 711,253

[22] Filed: Sep. 9, 1996

Related U.S. Application Data

[62] Division of Ser. No. 409,184, Mar. 16, 1995, Pat. No. 5,611,161.

[51] Int. Cl.[6] ..... B65H 45/30

[52] U.S. Cl. ..... 493/397; 493/405; 493/944

[58] Field of Search ..... 493/397, 398, 493/399, 405, 458, 355, 356, 944

[56] References Cited

U.S. PATENT DOCUMENTS

| | | | |
|---|---|---|---|
| 1,008,195 | 11/1911 | Prichard . | |
| 1,658,968 | 2/1928 | Carroll . | |
| 2,377,346 | 6/1945 | Horr | 40/491 X |
| 2,377,414 | 6/1945 | Gold | 40/491 X |
| 2,554,098 | 5/1951 | Eisner | 446/151 |
| 3,090,144 | 5/1963 | Malamude . | |
| 3,441,208 | 4/1969 | Goldstein | 235/70 |
| 4,062,138 | 12/1977 | Warenback . | |
| 4,161,833 | 7/1979 | Wagner . | |
| 4,626,939 | 12/1986 | Schoettle | 493/355 |
| 5,010,669 | 4/1991 | Moran . | |
| 5,112,290 | 5/1992 | Hibsch | 493/325 |
| 5,141,253 | 8/1992 | Rice | 283/65 |
| 5,259,133 | 11/1993 | Burtch . | |
| 5,450,680 | 9/1995 | Bromberg | 40/124.1 |

FOREIGN PATENT DOCUMENTS

| | | |
|---|---|---|
| 0647930 | 12/1995 | European Pat. Off. . |
| 2708126 | 9/1994 | France . |

*Primary Examiner*—Jack W. Lavinder
*Attorney, Agent, or Firm*—Browdy and Neimark

[57] ABSTRACT

A method of making a pop-up device for a card, book, novelty, or the like with a sandwich-like structure including a base or back (300), a front or cover (200), and a tongue (130) disposed between. All three sections may be of equal length. The three sections are folded onto one another and glued to make the sandwich. The tongue has a protruding tab end (135) for a user to pull; the end distal the tab end is fastened to a portion of the cover. A pull-slot (325) cut out between the cover and back guides the tongue for pulling to eliminate shims. The cover is slit by two parallel cuts (210) and three crosswise creases. The cuts are parallel to the tongue. The creased portion of the cover pops up when the tongue is pulled by a user. The fold lines are perpendicular to the direction of the tongue movement.

13 Claims, 2 Drawing Sheets

FIG. 1
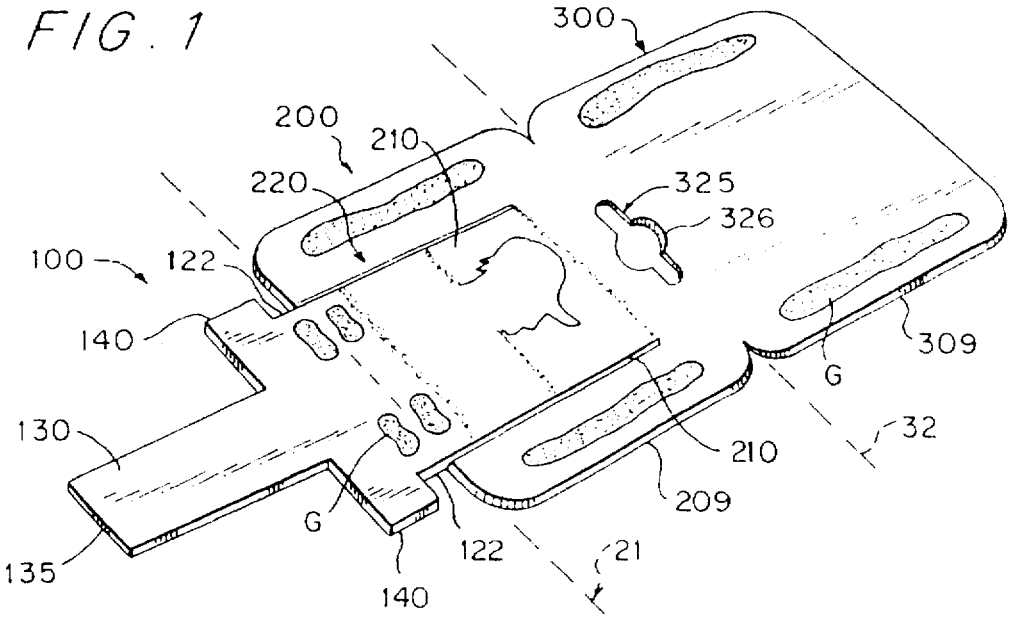
FIG. 2
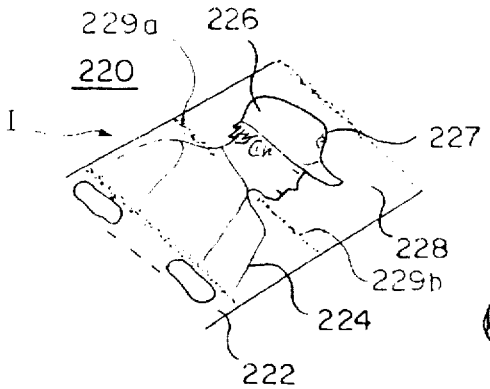
FIG. 3
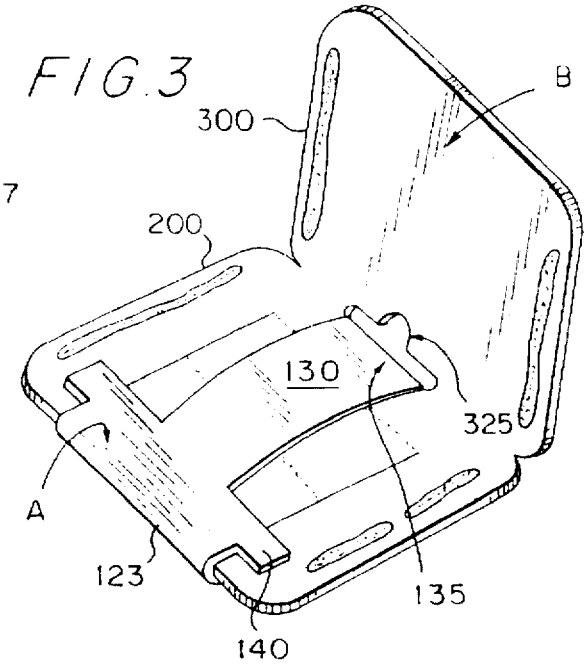
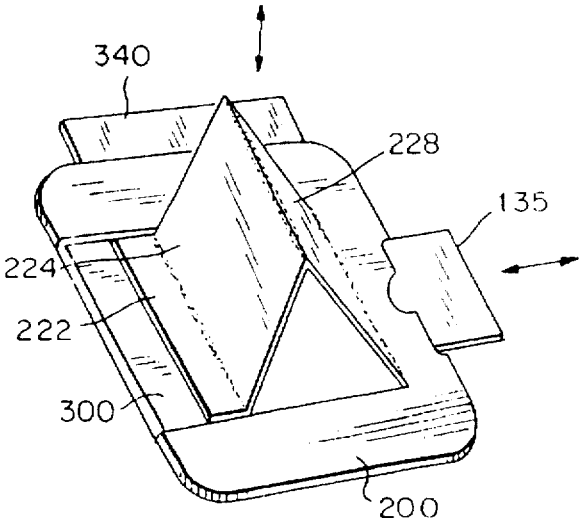
FIG. 4

METHOD FOR TRANSVERSE-FOLD POP-UP

This is a division of parent application Ser. No. 08/405,184 filed Mar. 16, 1995 now U.S. Pat. No. 5,611,161.

FIELD OF THE INVENTION

The present invention relates to pop-up display and similar devices wherein two portions of the device slide against one another and another portion is raised from the plane of sliding as a display.

BACKGROUND OF THE INVENTION

Greeting cards and children's books often include pop-up displays. Examples are sliding cut-outs with edge-operated tabs that cause the cut-out figures move on a page, and stand-up displays that arise when pages are unfolded.

U.S. Pat. No. 1,658,968 to Carroll shows a display device with three layers. The inner layer moves within an envelope formed by the outer layers. A slide member of the inner layer protrudes from the envelope; when it is pulled, the display changes by relative sliding of panels of the back and inner layers. There is no folding, and no pop-up feature.

U.S. Pat. No. 1,008,195 to Pritchard shows a hollow postcard from which an inner card may be pulled. The inner card has longitudinal cuts and creases that allow an inner portion to be folded up. The creases do not appear to interact with the envelope.

Warenback's U.S. Pat. No. 4,062,138 shows a pedestal display device made from a blank of cardboard with a die-cut inner display portion. The display portion is pulled loose and the surrounding part folded to form a base to support the display portion. No pop-up feature is disclosed.

Moran, in U.S. Pat. No. 5,010,669, shows a partially die-cut postcard that folds into a display and stand. It is similar to Warenback. U.S. Pat. No. 4,161,833 to Wagner shows a stand-up display board and base die-cut from the same blank.

U.S. Pat. No. 3,090,144 to Malamude discloses a pop-up display for greeting cards, store advertisements, etc. The pop-up action is performed by a rectangular paper box glued into the card. The box has ends adapted to allow it to collapse into a plane when the card is closed and lie between two sheets; when the card is opened the device forms a rectangular corner step between the two opened sides of the card. The display appears by unfolding (changing the angle at a fold) only and not by pulling a slide member (sliding one part over another). Malamude also shows stacked folded pop-ups.

U.S. Pat. No. 5,259,133 to Burtch discloses a pop-up card and a blank for making the card. The device includes a base sheet 12, a cover sheet 20, and an actuator (slide) member 16. A tab end 14 of the slide member protrudes from between the cover and the base, which have mating indentations to provide a grasping point on the slide member. The end of the slide member distal from the pull tab is glued to a die-cut and creased portion of the cover. When the tab is grasped and pulled, that portion of the cover folds into a tent-like shape. The Burtch card is formed by folding a blank along fold lines that run parallel to the slide member, as shown in FIGS. 2–5 of the Burtch '133 patent. When the card is assembled and the pop-up display is worked, the slide member moves in a direction parallel to the assembly fold lines.

The Burtch design has the disadvantage that portions of the blank, such as strip 42 portion and pull tab portion 32, must be separated from the blank and then glued back on.

Each such piece requires separate alignment. Another disadvantage is that the folds are not spaced at regular intervals, which complicates automatic assembly. As seen in Burtch FIG. 2, the distance from fold line 34 to fold line 38 is much greater than the distance from fold line 34 to the edge at 48, which is the end of the left-most fold section after the slide member 32 is cut away. The difference in distance means that if the Burtch device is made by folding equipment, the equipment must alternately make folds at two different distances from edges, complicating the manufacture thereof.

Cards related to the Burtch '133 disclosure include a type of circular cardboard baseball card (one such card bears the indicia "Innovative Promotions Int'l Ltd. U.S. Pat. No. 5,259,133" and "Printed in Canada"). This card is made from a circular base; a slide member having the shape of a similar circle but with chords removed to leave parallel sides equidistant from the center of the circle; a circular cover with parallel cuts; and two shims having the shape of the chords missing from the slide member, lying between the cover and base. The base, shims, and cover are glued together to form a sandwich. The slide member end distal the pull tab is glued to the cover, and the cover is creased in between its two ends. When the tab is pulled, the cover folds about the crease line and pops up.

The cover is die-cut around a figure, the head and torso of a baseball player. The cut extends between two ends of the crease. The cut-out figure extends outward when the display pops up, as taught by the Burtch patent. There are no folds visible and this card apparently is assembled from five separate pieces: base, cover (20 in Burtch), slide member (16 in Burtch), and two side shims (42 and 44 in Burtch). The great number of pieces which must be independently and stepwise aligned and glued make this card difficult to assemble, whether by hand or by machine.

In Burtch-type cards, the slide member is made wider than the distance between the cuts on the cover so as to retain the slide member edges between the base and the cover. This has the disadvantage that the width of the slit, through which the slide member is worked back and forth to pop up the display, must be as wide as the slide member. The wide opening weakens the structure.

In such Burtch-type cards, shims are needed as guides for the slide member because there is nothing to locate the slide member laterally where it emerges from the envelope formed by the base and cover. Without the shims the slide member could cock (rotate about a line normal to the plane of the card) and jam. Were the cover and base merely glued together without shims there would be no definite edge for the slide member to bear against, and consequently the cover and base would be pried apart by sideways action of the slide member, if the slide member were not pulled straight out each time. The slide member edge would peel the cover from the base and ruin the card. Adhesives are notoriously prone to failure under peeling action.

The prior art does not disclose any pop-up structure that can be made without shims and still withstand normal use, nor does it disclose any means of locating a pull-tab slide member without shims. Also, the prior art does not disclose any pop-up device that does not require assembly of disconnected parts. Further, the prior art also does not show any pop-up card or blank for a pop-up card which is adapted to automatic assembly.

SUMMARY OF THE INVENTION

Accordingly, the present invention has an object, among others, to overcome deficiencies in the prior art, such as noted above.

The invention thus provides a device for pop-up display made of a sheet of foldable material including a slider first section having a first section length, a cover second section having a second section length and a second section width, and a base third section having a third section length and a third section width. The boundary between the first section and the second section is a first fold line about which, in a first sense of rotation, the first section is folded onto the second section. The boundary between the second section and the third section is a second fold line about which, in a second sense of rotation, the third section is folded onto the second section.

An elongated tongue comprises most of the first section. The tongue has a tongue width less than the second section's width. The tongue includes a tab end distal the first fold line for grasping by the user of the device. The tab end protrudes from a pull-slot preferably along the second fold line. The slot has a width equal to or greater than the tongue width and less than the second section width.

A plurality of parallel cuts extend, perpendicular to the first fold line, at least part-way through the second section. The cuts are separated by a cut width less than the second section width. To allow poping-up action, there is at least one crease in the second section extending transversely between the cuts. The third section is fastened to the second section along respective edges by glue or other fastening means.

As a result of the construction of the present invention, when the tab end is pulled from the pull-slot by a user, pop-up portions of the second section containing the crease pop up to a tent-like formation.

BRIEF DESCRIPTION OF THE DRAWING

The above and other objects and the nature and advantages of the present invention will become more apparent from the following detailed description of an embodiment taken in conjunction with drawings, wherein:

FIG. 1 is a perspective view of a blank in accordance with the invention, with its bottom side facing upwardly;

FIG. 2 is a detailed view of a part of the blank of FIG. 1;

FIG. 3 is an upside-down perspective view of the blank of FIG. 1 being folded to form a pop-up device according to the present invention;

FIG. 4 is a perspective view of a pop-up device according to the present invention showing pop-up action.

DETAILED DESCRIPTION OF THE PREFERRED EMBODIMENT

Figure 5:
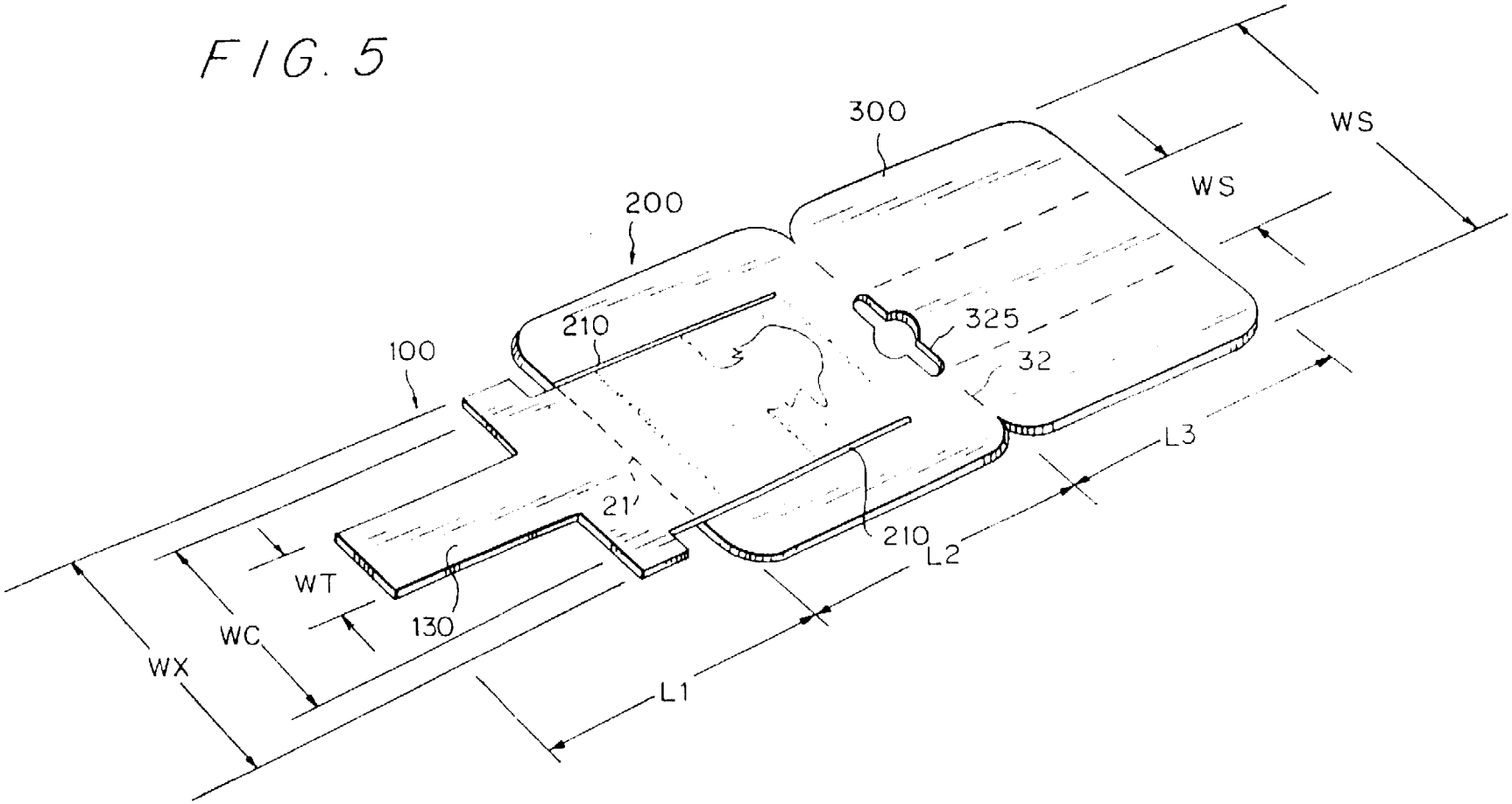
FIG. 5 is perspective view similar to FIG. 1 showing dimensions of the blank.

Here, and in the following Specification and Claims:

"blank" means a portion of sheet material (e.g., paperboard, plastic, paper, stiffened fabric, etc.) which is adapted to forming a pop-up structure; it also means a portion of such material that has been die-cut, trimmed, creased, folded, or otherwise treated to adapt it to form a pop-up structure;

"crease" means a region, such as a line in a blank, that has been adapted to act as a hinge between adjacent sections of the blank; as for example by partial perforations or cuts, by creasing, by folding, by deforming the blank material (e.g., crimping), by weakening the blank material in the region by repeated bending or by other means (including chemical and thermal treatments), or by other means or methods;

"fold line" means a line about which folding can or should occur; this terms includes a geometrical line about which folding can or should occur, with or without any physical delineation such as a printed line mark, a crease, perforations, or the like;

"length," "lengthwise," "longitudinal" and the like terms refer to a direction generally parallel to the direction of working motion of a tongue, tab, or other slide element which a user slides relative to the rest of a pop-up device to activate a pop-up feature or display; and "width", "across", "transverse", "lateral", and the like terms refer to direction perpendicular to the length.

The present invention relates to a pop-up card or other device, to a method of folding, and also to a blank for making or practicing the invention.

FIG. 1 shows a blank of the invention in perspective view. The blank comprises three sections: a slider or first section 100; a cover or second section 200; and a base or third section 300. The three sections are folded together to form the pop-up device of the invention, as shown in FIG. 3.

Referring again to FIG. 1, the three sections are separated by fold lines 21 and 32. The lines 21 and 32 may be only geometrical entities rather than physical lines, creases, or the like on the blank, depending on the design choice of manufacture. The blank is desirably made of paperboard (sometimes called "cardboard") or similar sheet material which can be folded readily, yet has sufficient stiffness to withstand normal use and mechanical action.

The first slider section 100 includes a relatively narrow tongue 130 extending away from the first fold line 21, two lateral or transverse extensions 140, and a relatively short glue strip 122 adjacent to the fold line 21.

A glue area G, indicated by stippling, is disposed on the surface of the glue strip 122 proximal the first fold line 21 and on the adjacent glue strip area 222 of the second section 200 adjacent thereto. Glue in these areas fastens the first glue strip 122 onto the adjacent second glue strip of the second section to provide a stiff double-thickness edge member 123 as shown in FIG. 3 when the slider section 100 is folded over as shown by arrow A.

The second section or cover 200 includes a lengthwise side edge 209 on either side, glue areas, and a central pop-up region 220 which is bordered by parallel cuts 210 which separate the side edges 209 from the interior part 220. FIG. 2 shows the pop-up central region 220, which further includes the narrow strip area 222 which is glued in place and lies flat against the slider section 100, a first popping portion 224, and a second popping portion 228. (The portions 224 and 228 are shown in FIG. 4 in the popped-up position.) An optional cut-out region 226 is separated from the portion 228 by a cut 227; if present, the cut 227 may be a full cut, or a sparsely perforated cut.

Referring again to FIG. 1, between the cover 200 and the base 300, along the second fold line 32, is a pull-slot 325. The pull-slot 325 preferably includes indentations 326 on either side of the slot 325; these allow a user to grasp a protruding object such as the tongue 130 which protrudes through the pull-slot 325 after the base 300 has been folded onto the cover 200 as shown in FIG. 3 by the arrow B.

FIG. 3 shows folding of the blank depicted in FIG. 1 to form the pop-up device. As shown in FIG. 3, the first section 100 has been folded over the first fold line 21 as indicated by arrow A to bring the tab end 135 proximal the pull-slot 325. Arrow B indicates folding of the third section 300 over the second section 200, which follows the folding of the first section 100 onto the second section 200. It will be noted that the first fold, indicated by arrow A, is in opposite sense to the second fold, indicated by arrow B; when viewed along a line parallel to either of the fold lines 21 or 32, the folding directions A and B are respectively clockwise and counter-clockwise (or the converse when viewed from the opposite side). If the fold rotations A and B were in the same sense of rotation, then the tongue 130 would not be disposed between the base 300 and the cover 200 and it could not pass through the pull-slot 325.

FIG. 4 depicts the invention as an assembled pop-up card. (FIG. 4 depicts the invention of FIGS. 1–3 turned over about a horizontal axis to the top-side-up, and without the cut-out 226.) When a user's fingers (not shown) grasp the tab end 135 and move it to and fro in the direction indicated by the horizontal arrow, the region 224 and 228 of the pop-up portion 220 will form a tent-like structure as shown in FIG. 4. The apex will move up and down in the direction indicated by the vertical arrow. This of course involves creasing the pop-up portion 220 of the blank between the first popping portion 224 and the second popping portion 228. In the second section is included at least one crease extending transversely between adjacent ones of the cuts 210.

The pop-up of FIG. 4 includes a transverse appendage 340 extending from the side of base 300, which may be used to attach the pop-up.

It is preferred that the cuts 210 number two, but to form more elaborate pop-ups (not shown) they may number greater than two.

Unlike prior art pop-up cards and other pop-up devices, the device of the present invention automatically provides for lateral guiding of the tongue 130 as it is moved through the pull-slot 325. The tongue 130 is held between sections of the sheet material at either end of pull-slot 325. Because of this, the tongue is firmly held against lateral rotation without additional structures such as shims.

At the end of the tongue 130 that is distal the tab end 135, the extensions 140 are held between the cover 200 and the base 300. The extensions 140 prevent the glued-together strips 122 and 222 from falling away from the base 300 as the tongue 130 is moved.

It will be noted that the fold lines 21 and 32 need not be parallel. The only requirement is that the slot 325 be wide enough to accept therethrough the tongue 130 and that it be laterally located where the tongue 130 will intersect it upon the folding of the first section 100 over the second section 200.

FIG. 5 shows dimensional relationships of the blank of FIG. 1 which must be maintained if the invention is to work properly. In FIG. 5 L1, L2, and L3 denote the lengths transverse to the fold line 21 of the sections 100, 200, and 300. These lengths need not necessarily be equal. However, it is preferable that the lengths L2 and L3 be equal to avoid overhanging edges after folding about the line 32. If L1 is equal to L2 and L3, then after folding the tab end 135 can be grasped by a user's fingers because the indentations 326 of the pull-slot 325 expose sufficient area of the tab end 135 that it can be grasped.

It may be preferable to have all three lengths L1, L2, and L3 equal for the following reason: the present invention is well adapted to automatic manufacture by machinery. Such machinery may include folding equipment which is easier to design, build, and maintain if it folds only at regular intervals, rather than at varying intervals along the length of the blank. This is especially true if blanks are continuously made from a roll of sheet material.

The width of the tongue 130, WT in FIG. 5, must be equal to or less than the width WS of the pull-slot 325. It is preferably just slightly less. The dimension WT must also be less than the width-wise distance WC between the cuts 210. The width WX across the extensions 140 must be greater than WC, so that the extensions 140 will each be retained between the base 300 and a respective portion of the cover 200 bordered by edge 209 and cut 210. This retention is needed to prevent the folded and glued end, that is formed by strips 122 and 222, from lifting off the base 300 when the tab end 135 is pulled.

Alternative embodiments are contemplated by the present invention.

Various outline shapes for the base 300 or cover 200 may be provided, and the outlines of these sections need not be congruent. For example, one of the section 200, 300 could be wider than the other, so that the protruding edges can be folded over and glued, if desired, either onto an outside of the device or between the sections 200 and 300, to stiffen the edge.

Either one of the sections 200 or 300 may be extended transversely to the length of the blank to provide the folded card with an appendage by which it may be hung or joined with other devices, pages, or cards to make a pop-up book. An example of such an appendage, labeled 340, is shown in FIG. 4. A plurality of the device need only by stapled or glued together by such appendages to form a book. The pull-tabs 135 may be disposed either up or down in such a book depending on which side of the blank and which section has the extension.

Also as an alternative, the present invention may omit the glued stiffening member 122/222; in this case the fold line 21 may double as a crease to form one side of the tent-like pop-up structure.

In one aspect of the invention, the pop-up portion is provided with the cut-out 226 to form an outline of a figure of interest. The exemplary outline shown in FIG. 1, of a baseball player, preferably would surround printed indicia of the outlined baseball player. (The indicia would be impressed on the hidden side of the blank in FIG. 1; when the blank is folded, the indicia would then be on the outside of the device of FIG. 4. However, FIG. 2 shows exemplary indicia I for the cut-out 226 outline and the first popping portion 224 as they would be if the blank of FIG. 1 were mirror-image reversed.) A free-standing or partially free-standing depiction by indicia on a flat surface creates a more realistic effect when the figure is surrounded by a cut. Although in smaller-scale items such as sports cards the effect is less pronounced than in life-size store displays, in the present invention the outline of the entity depicted should preferably coincide with the edge of the sheet or blank. Accordingly, the line cut 227 that replaces the middle part of the crease may be non-linear and correspond by congruent shape to at least part of the entity depicted by indicia on the blank. As shown in FIG. 2, the cut line 227, like the middle part of the crease it replaces, is bordered by a first side part of the crease **229*a* and a second side part of the crease 229*b*. The first part 229*a*, cut line 227, and second part 229*b* are continuous and separate the first popping portion 224 and the second popping portion 228. The terms "first" and "second" are arbitrary, merely denoting different sides of the crease. When the tongue 130** is pulled, the pop-up portions then present a partially free-standing figure.

Various means for fastening the third and second sections may be employed either singly or in combination. Such means for example might include glue, tape, staples, re-useable adhesive, crimping, and so on.

The present invention has several advantages over prior-art devices and blanks.

Whether assembled by hand or by machine, the present invention can be assembled easily because it has a one-piece blank.

The present invention can be made by relatively simple and inexpensive automatic equipment that cuts and folds a long roll of blank material. A key factor is that all the folds are made transverse to the length of such roll material, so that all the folding operations are about axes perpendicular to the travel direction. The equipment is even simpler if the three dimensions L1, L2, and L3 are all the same, as discussed above.

No separated pieces need to be aligned and then fastened to the other parts of the device. This further simplifies the manufacture.

A structural advantage is that the pull-slot 325 forms a strong guide for the tongue 130, without any shims. The pull-slot is stronger than shims because there is no joint next to the tongue 130, only a fold in a single piece of sheet material. The entire structure is stronger because there is only one glue joint along the edges 209 rather than two glue joints as taught by Burtch.

The foregoing description of the specific embodiments will so fully reveal the general nature of the invention that others can, by applying current knowledge, readily modify and/or adapt for various applications such specific embodiments, without departing from the generic concepts, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A method of making a pop-up, comprising:

providing a blank having a blank length and edges separated by a blank width, the blank including a tongue at a first end and a pull-slot intermediate the tongue and a second end, the pull-slot having a pull-slot width less least equal tk width and at least equal to a tongue width;

creasing a pop-up portion of the blank intermediate the tongue and the pull-slot;

folding the tongue onto a second section of the blank about a first fold line in a first sense of rotation, the first fold line separating the second section from a first section of the blank, the first fold line being angled to the length such that the tongue aligns with the pull-slot;

folding a third section of the blank onto the second section about a second fold line in a second sense of rotation;

fastening the second section to the third section proximal the edges; and providing slide means for slidably holding a base end of the tongue, proximal the first fold line, adjacent the third section.

2. The method according to claim 1, comprising steps of:

wherein the first section comprises a slider having a first section length and the tongue;

wherein the second section comprises a cover having a second section length and a second section width equal to the blank width;

wherein the third section comprises a base having a third section length and a third section width;

setting the blank length equal to a sum of the first section length, the second section length, and the third section length;

extending the first fold line generally transversely to the blank length;

disposing the second fold line between the second section and the first section;

including in the tongue a tab end distal the first fold line for grasping by a user;

setting the pull-slot width to less than the second section width, and disposing the pull-slot along the second fold line such that the pull-slot is surrounded by continuous material of the blank;

including in the pop-up portion a plurality of parallel cuts extending perpendicularly away from the first fold line and continuing at least part-way through the second section, outermost ones of the cuts being separated by a cut width less than the second section width;

including in the second section at least one crease extending transversely between adjacent ones of the cuts;

whereby after the pop-up is made, the tongue is pullable from the pull-slot so that the second fold line moves toward the first fold line and pop-up portions of the second section pop up about the crease.

3. The method according to claim 2, comprising steps of:

providing that the crease further include a middle part, a first side part, and a second side part; and interrupting the crease by a non-linear line cut replacing the middle part of the crease and extending from the first side part to the second side part;

whereby, when pop-up portions of the second section pop up, the pop-up portions present a non-linear edge shape adjacent the crease.

4. The method according to claim 3, comprising a step of including in the second portion indicia of a depicted entity, the entity having an outline congruent with the edge shape; whereby the entity appears at least partially without a background.

5. The method according to claim 2, a step of setting the second fold line generally parallel to the first fold line.

6. The method according to claim 2, comprising a step of setting the third section width generally equal to the second section width.

7. The method according to claim 2, comprising a step of setting one of the first section length and the third section length generally equal to the second section length.

8. The method according to claim 2, comprising steps of:

including in the first section a first glue strip region proximal the first fold line;

including in the second section a second glue strip region proximal the first fold line; and including in the second section a second crease intermediate the second glue strip region and the pop-up portions of the second section;

whereby the first glue strip region and the second glue strip region may be fastened together, and a stiffening member may be formed by the first glue strip region and the second glue strip region.

9. The method according to claim 2, comprising a step of disposing the pull-slot along the second fold line, such that the pull-slot indents a folded edge between the third section and the second section.

10. The method according to claim 9, comprising a step of including, in the pull-slot, indentations into the second section and the third section.

11. The method according to claim 2, comprising a step of providing the blank with a transverse appendage for mounting.

12. The method according to claim 1, comprising steps of setting the third section width generally equal to the second section width, and setting the second fold line generally parallel to the first fold line.

13. The method according to claim 12, comprising a step of setting one of the first section length and the third section length generally equal to the second section length.

* * * * *